United States Patent [19]

Ezekoye

[11] 4,064,580

[45] Dec. 27, 1977

[54] MULTI-POSITION MULTI-PURPOSE SUPPORT AND STORAGE STRUCTURE

[76] Inventor: Levi Ike Ezekoye, P.O. Box 8611, Pittsburgh, Pa. 15221

[21] Appl. No.: 731,921

[22] Filed: Oct. 13, 1976

[51] Int. Cl.[2] ..... A47C 7/02; A47C 22/00

[52] U.S. Cl. ..... 5/327 B; 248/451; 248/460; 297/377; 297/439

[58] Field of Search ..... 5/327 R, 231, 351; 297/377, 439, 456, 460; 248/126, 441 R, 466, 451; 211/2, 42

[56] References Cited

U.S. PATENT DOCUMENTS

| | | | |
|---|---|---|---|
| 2,244,440 | 6/1941 | Archer | 5/327 R |
| 2,642,190 | 6/1953 | Kelly | 248/126 |
| 3,041,774 | 7/1962 | Walker | 248/460 |
| 3,195,850 | 7/1965 | Sleiner | 5/327 R |
| 3,876,247 | 4/1975 | Chilewich | 297/118 |

FOREIGN PATENT DOCUMENTS

| | | | |
|---|---|---|---|
| 1,100,080 | 9/1955 | France | 297/377 |

*Primary Examiner*—Casmir A. Nunberg

*Attorney, Agent, or Firm*—Strauch, Nolan, Neale, Nies & Kurz

[57] ABSTRACT

A multi-position support structure providing a firm support surface selectively disposable at different angles for supporting articles or portions of the human body.

The device also provides interior space for the storage of articles such as books or magazines.

3 Claims, 5 Drawing Figures

MULTI-POSITION MULTI-PURPOSE SUPPORT AND STORAGE STRUCTURE

BACKGROUND OF THE INVENTION

In the past so-called recliners or cushions have been proposed which provide alternate positions of use for supporting the user in a generally upright position or in a position of repose. Such proposals are exemplified by U.S. Pat. Nos. 2,244,440; 2,769,486; 3,003,815; and 3,120,008.

While certain of these prior devices have at least limited effectiveness for specialized use, they are in some cases of relatively complex construction, require adjustment, or repositioning of parts. In many cases they do not provide the rigid support required for many applications and none provide an effective available article storage space.

SUMMARY OF THE INVENTION

It is a principal purpose and object of the present invention to provide a two-position hard surface support or recliner which is rigid, durable, and of relatively uncomplicated construction so as to permit its manufacture and sale at a modest price.

In attaining these and other objects, the present invention provides a two-position recliner or support comprising a main planar rigid support member together with alternate base structures rigid with the support member to permit the stable disposition of the support surface in either of two angled positions with respect to a floor, table or other similar surface.

The recliner of the present invention is always ready for instant use and may be disposed in either of its two principal positions without the adjustment of parts.

The recliner of the present invention is of rigid, durable construction and retains its configuration despite the application of relatively heavy loads. By virture of the utilization of a unique angular and dimensional relationship between the support surface and the base structure, the recliner achieves stability under any given applied load and effectively resists tipping or displacement.

The recliner of the present invention also provides a convenient, readily accessible storage space for small articles, such as magazines or books.

Additional objects and advantages of the present invention will become apparent as the description proceeds.

THE DRAWINGS

DESCRIPTION OF PREFERRED EMBODIMENT

Figure 1:
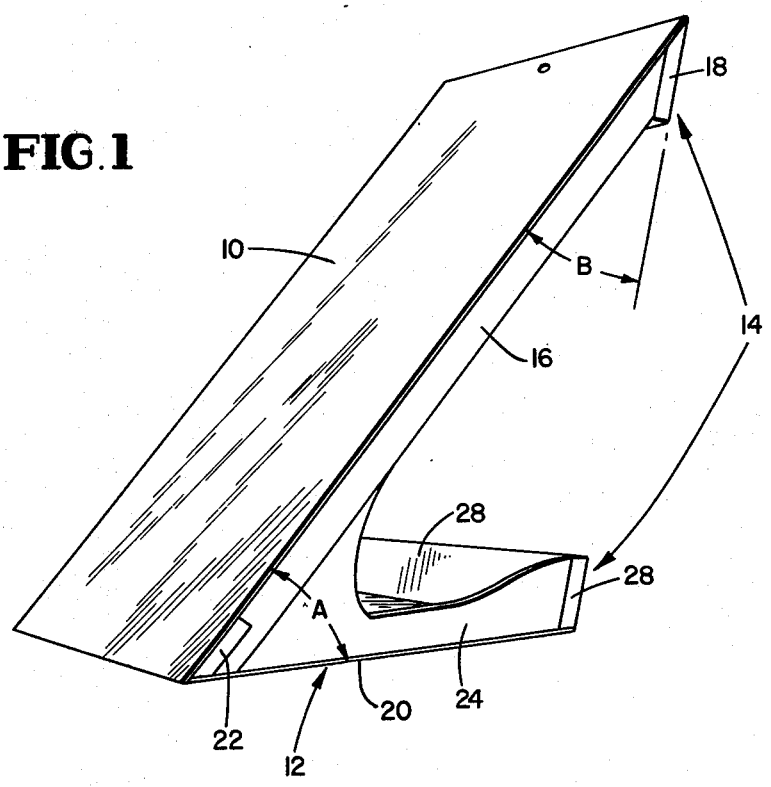
FIG. 1 is a perspective view of the recliner shown in position to dispose its main support surface in a generally upright position.
Figure 4:
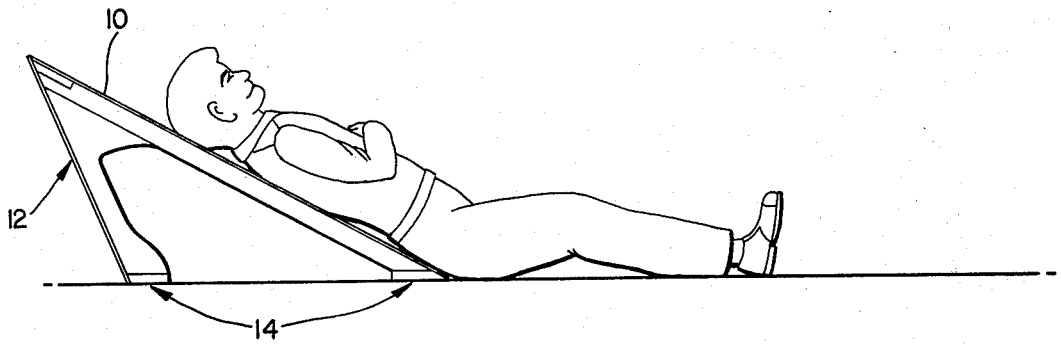
FIG. 4 is a side view of the recliner as disposed in its alternate position.

Referring now more particularly to the drawings, the recliner of the present invention comprises a main, rigid support member 10 adapted to be supported in a generally upright position as shown in FIG. 1 on a first base structure indicated generally at 12 and in a less steeply inclined position as shown, for example, in FIG. 4 on a second base structure indicated generally at 14.

The unit may be made of a variety of materials, such as wood, masonite or plastic. In all cases, however, the materials selected should provide the requisite strength, rigidity, light weight and low cost.

In the illustrated embodiment, the main support member 10 and the base structure 12 are of ½ inches thick masonite and the remaining components are wood. All of the parts may be secured together by screws or glue to form a strong, rigid, durable construction.

A pair of stiffeners 16 extend along the side edges of the main support member 10 and are suitably secured at one end to a cross-member 18 which extends along one end of the support member 10 to form a portion of the base structure 14. The adjacent ends of the main support member 10 and the main base member 20 are suitably secured to appropriately angled surfaces of a cross-brace 22. Additional bracing is provided by side members 24 and 26 which are suitably secured to the base member 20 and to the main support member 10 and to the stiffeners 16. This structure is completed by a cross-strip 28, which extends across the unit from side to side and is secured to the end of the base member 20 and the adjacent surfaces of the brace members 24 and 26. It will be noted that the base members 28 and 18 are coplanar to form the base structure when the unit is utilized in the position of FIG. 4.

Figure 2:
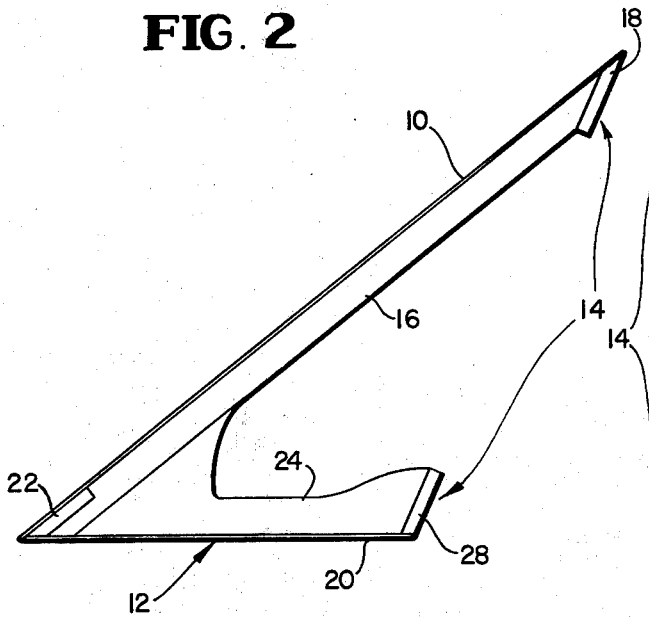
FIG. 2 is a side view of the recliner of FIG. 1.
Figure 3:
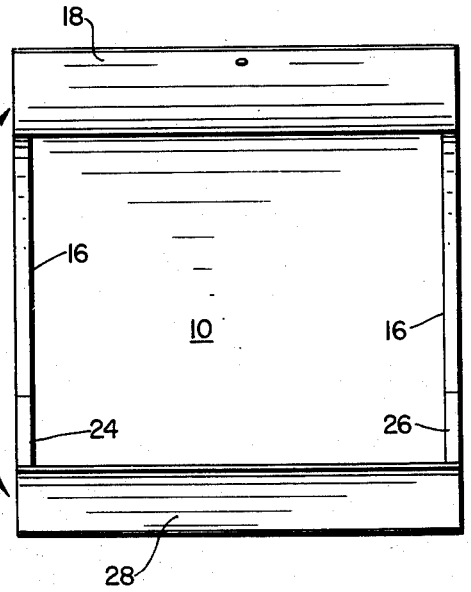
FIG. 3 is a rear view of the recliner of FIG. 1.

When the unit occupies the position of FIGS. 1 and 2, the support surface 10 is disposed at a pitch angle A which is the angle between the support surface 10 and the base structure 12 and when the unit is installed in a position of FIG. 4, the support surface is disposed at a pitch angle B with respect to the supporting surface.

It is a feature of the invention that the unit is stable in either of its positions, that is, it resists tipping on the application of applied load and is resistant to displacement along its supporting surface. To achieve this result it has been discovered that the sum of the pitch angles A and B shall be not more than 80° for most common surfaces. It has also been discovered that the larger pitch angle A shall be less than 45°.The tangent of the smaller pitch angle B shall be greater than one-half of the sine of double the pitch angle A divided by the quantity (2-cosine of double the pitch angle A).

So long as these angular relationships are maintained the unit can be scaled up or down as desired. Typically, a recliner designed for general use may have a main support surface approximately 27 inches by 16 inches, and a base 20 approximately 14 inches by 16 inches. If desired, the upper surface of the main support member 10 may be covered by a cushion or pad of conventional construction.

Figure 5:
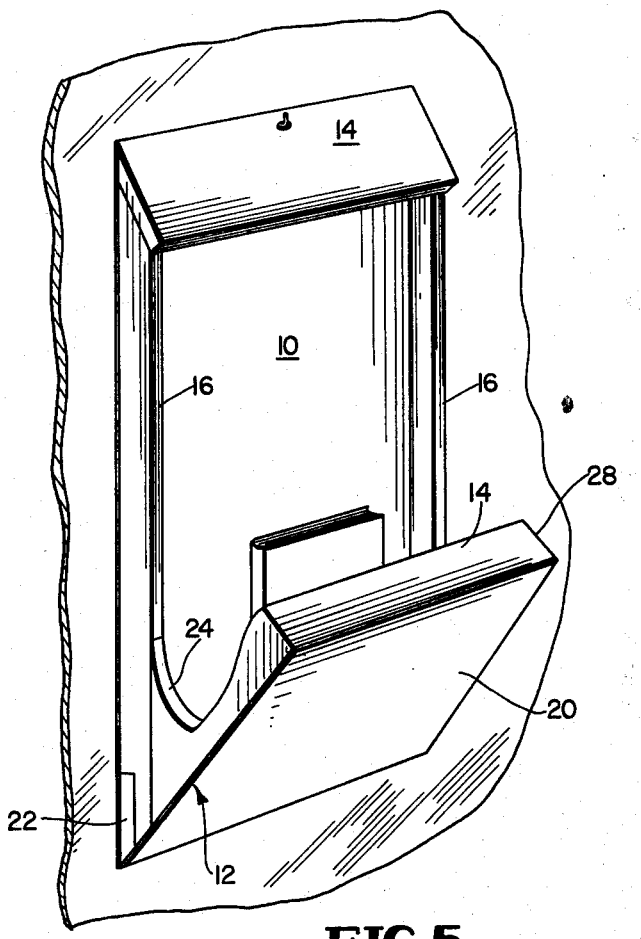
FIG. 5 is a perspective view of the recliner illustrating the manner of its utilization as a storage cabinet.

In addition to its utility for supporting the head and upper body of user or the legs of a user in a suitably elevated position, the unit may also be installed as shown in FIG. 5 to provide a convenient and decorative storage space for books, magazines and the like, the base structure 12, the side supports 24 and 26 and the cross-member 14 providing, with the main support member 10, a storage base of considerable volume. Also, the base member 18 provides a convenient handle to enhance supportability of the unit.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A multi-purpose, multi-position support structure comprising an essential planar rigid support member, first and second planar base assemblies rigid with said main support member, said first and second base assemblies being disposed at first and second different angles with respect to said main support member and adapted to provide stable support for said main support at different angles with respect to a supporting surface, said second angle being larger than said first angle and being not greater than 45° and the sum of said first and second angles being not greater than 80°.

2. This structure according to claim 1 wherein the tangent of said first angle is greater than ½ of the sine of double the second angle divided by the quantity (2 - cosine of double said second angle).

3. The structure according to claim 1 wherein one of said base assemblies forms with the adjacent portion of said support member a storage compartment and the other base assembly is interrupted intermediate its ends to provide access to said storage compartment.

* * * * *